US007243462B2

(12) United States Patent
Langenhorst

(10) Patent No.: US 7,243,462 B2
(45) Date of Patent: Jul. 17, 2007

(54) ACCESS DOOR

(75) Inventor: Günter Langenhorst, Soest (DE)

(73) Assignee: Knauf Gips KG, Iphoven (DE)

( * ) Notice: Subject to any disclaimer, the term of this patent is extended or adjusted under 35 U.S.C. 154(b) by 0 days.

(21) Appl. No.: 10/944,687

(22) Filed: Sep. 17, 2004

(65) Prior Publication Data

US 2005/0091930 A1 May 5, 2005

(30) Foreign Application Priority Data

Sep. 19, 2003 (DE) ..... 103 43 392

(51) Int. Cl.
*E05C 9/00* (2006.01)

(52) U.S. Cl. ..... 49/395; 292/91; 292/303; 292/341.17

(58) Field of Classification Search ..... 49/394, 49/395; 292/303, 341.17, 91
See application file for complete search history.

(56) References Cited

U.S. PATENT DOCUMENTS 669,008 A * 2/1901 Franken ..... 292/202
1,973,971 A * 9/1934 West ..... 292/76
4,709,949 A * 12/1987 Umezawa et al. ..... 292/6
4,881,764 A * 11/1989 Takahashi et al. ..... 292/13
6,038,892 A * 3/2000 Schmitt ..... 70/78
6,446,393 B1 * 9/2002 Marston et al. ..... 49/395

FOREIGN PATENT DOCUMENTS

DE 37 36 060 12/1988

* cited by examiner

*Primary Examiner*—Jerry Redman
(74) *Attorney, Agent, or Firm*—Andrew Wilford

(57) ABSTRACT

An access door has a rectangular outer frame adapted to be set in a wall and having two longitudinal sides and two transverse sides defining four corners and a rectangular inner frame congruent to the outer frame, having longitudinal and transverse sides and four corners, and dimensioned to fit within the outer frame. Hinges at corners at ends of one of the longitudinal sides hold the inner frame in the outer frame and allow pivoting of the inner frame in the outer frame generally about the one longitudinal side. Two transversely effective spring latches are provided at the other longitudinal side near ends thereof between the inner and outer frames, and two longitudinally effective spring latches are provided at the transverse sides near the other longitudinal side between the inner and outer frames.

8 Claims, 3 Drawing Sheets

ACCESS DOOR

FIELD OF THE INVENTION

The present invention relates to an access door. More particularly this invention concerns a hatch or panel that is set in a ceiling or wall to allow occasional access to plumbing, wiring, or the like behind the ceiling or wall.

BACKGROUND OF THE INVENTION

In construction it is frequently necessary to provide occasional access to valves, switches, punch-down blocks, and the like that are behind the wall or ceiling. Such a door typically comprises an outer frame that is permanently set in the wall and an inner frame and panel that are secured to the outer frame by hinges along one edge and a releasable latch along an opposite edge. The access door need not be complex, as it is used infrequently, but must be unobtrusive when installed, that is typically be flush so it can be finished like the wall, and centered in its opening so it presents a nice appearance.

Thus a standard access door comprises as described in German patent 37 36 060 or EP 0,567,731 a pair of annular L-section frames, one within the other. The outer wall frame is typically set permanently in the wall, and the inner panel frame is adapted to hold a wall or ceiling panel and is releasably retained in the wall frame by some sort of hinge/latch assembly. In a typical installation the panel frame is adapted to hold one or two thicknesses of standard gypsum board, with in some instances a thin steel plate on the back face of the inset panel. The frames are formed with centering bumps that keep the inner frame at a uniform spacing withing the outer frame.

OBJECTS OF THE INVENTION

It is an object of the present invention to provide an improved access door.

Another object is the provision of such an improved access door whose center panel assembly is perfectly centered in the outer frame.

SUMMARY OF THE INVENTION

An access door has according to the invention a rectangular outer frame adapted to be set in a wall and having two longitudinal sides and two transverse sides defining four corners and a rectangular inner frame congruent to the outer frame, having longitudinal and transverse sides and four corners, and dimensioned to fit within the outer frame. Hinges at corners at ends of one of the longitudinal sides hold the inner frame in the outer frame and allow pivoting of the inner frame in the outer frame generally about the one longitudinal side. Two transversely effective spring latches are provided at the other longitudinal side near ends thereof between the inner and outer frames, and two longitudinally effective spring latches are provided at the transverse sides near the other longitudinal side between the inner and outer frames.

These spring latches not only releasably retain the door in a closed position, but they also serve to center the inner frame in the outer frame. Thus when the inner frame and the panel carried by it are pushed into the outer frame, these latches fulfill the dual function of retention and centering.

According to the invention each of the latches is provided with a spring seated in one of the frames and bearing on the other of the frames. Each spring is fixed to the one frame and each of the latches includes a keeper tongue on the other frame and in which the respective spring is seated in a closed position of the door to hold the inner frame in the outer frame. Each spring is generally U-shaped and has a bight secured to the one frame and a pair of arms bearing on the keeper tongue of the other frame. Each of the keeper tongues is a tab bent outward from and fixed to the other frame.

The springs of the transverse latches in accordance with the invention bear transversely inward on the inner frame and the springs of the longitudinal latches bear longitudinally inward on the inner frame.

BRIEF DESCRIPTION OF THE DRAWING

The above and other objects, features, and advantages will become more readily apparent from the following description, reference being made to the accompanying drawing in which.

SPECIFIC DESCRIPTION

Figure 1:
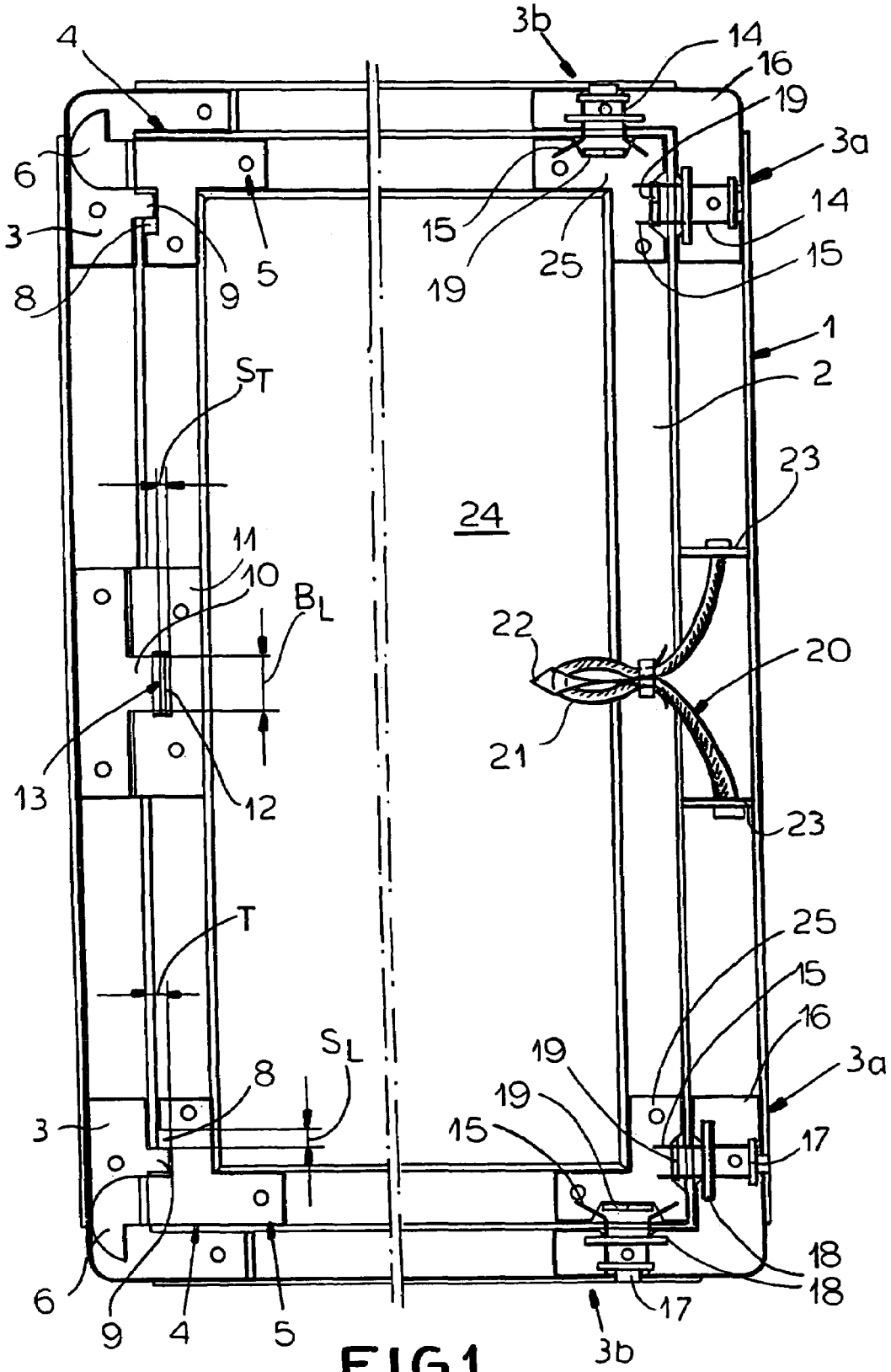
FIG. 1 is a rear view of the access door according to the invention in the closed position.

As seen in FIG. 1 an access door according to the invention has an outer L-section metal frame 1 adapted to be secured permanently in a wall or ceiling and an inner frame 2 also metallic and of L-section and holding a panel 24, e.g. a piece of fire-code gypsum board. Both the frames 1 and 2 are rectangular and have a back flange lying parallel to a wall plane and another flange perpendicular thereto. The inner frame 2 is secured in the outer panel 1 by two latches 3*a* along one longitudinal edge, two further latches 3*b* along opposite shorter transverse edges adjacent the latches 3*a*, and corner hinges 4 on ends of the long edge opposite the edge with the latches 3*a*. The term "longitudinal" here refers to the vertical direction as seen in FIG. 1 and "transverse" to the horizontal direction.

More particularly, the corner hinges 4, which are substantially identical, each comprise a rigid flat leaf 5 spot welded to a back face of the back flange of the inner frame 2 and a coplanar and rigid flat outer leaf 3 that lies against the back face of the back flange of the outer frame 1. Each inner leaf 5 is formed with a hook 6 so that the inner frame 2 has to be canted to be fitted through the outer frame 1. In addition each leaf 5 is formed with an outwardly and transversely open notch 8 into which fits an inwardly and transversely projecting tab or tooth 9 formed on the respective leaf 3 mounted on the outer frame 1. The notches 8 each have a longitudinal width greater by a spacing $S_L$ than a longitudinal width of the respective tooth 9, but the tooth 9 has a transverse dimension that is such that when the frame 2 is perfectly transversely centered in the frame 1, its outer end bottoms on the floor of the notch 8.

The frame 2 carries centrally between the hinges 4 a centering plate 11 formed with a central transversely outwardly open notch 12 into which fits a tab or tooth 10 carried on a plate 7 fixed to the outer frame 1. Both the notch 12 and tooth is, are of the same longitudinal width $B_L$ so that the tooth 10 fits snugly in the notch 12 when the frame 2 is perfectly longitudinally centered in the frame 1. The tooth 10 is, however, shorter transversely by a transverse spacing $S_T$ than the depth of the notch 12. Thus transverse centering of the frame 2 is taken care of by the two tabs 9 in the notches 8 and longitudinal spacing is the job of the center tab 10 in the notch 12. The inner end of the tab 10 is bent back at 13 (see also FIG. 2) to facilitate fitting of the inner frame 2 into the outer frame 1.

The latches 3*a* and 3*b* are identical and mounted on angle plates 16 at the respective corners of the outer frame 1 and similar angle plates 25 fixed to the corresponding corners of the inner frame 2. These latches 3*a* and 3*b* each have a U-shaped spring 14 with a bight seated in a respective pivot eye 17 bent outward from the respective outer plate 16. Each of the springs 14 further has two arms 15 that pass through respective guide plates 18 also bent outward from the outer plates 16 and that engage tongues 19 bent outward from the respective inner plates 25. The arms 15 whose ends can be formed as eyes, bear on the respective tongues 19 so as to push them away.

Figure 2:
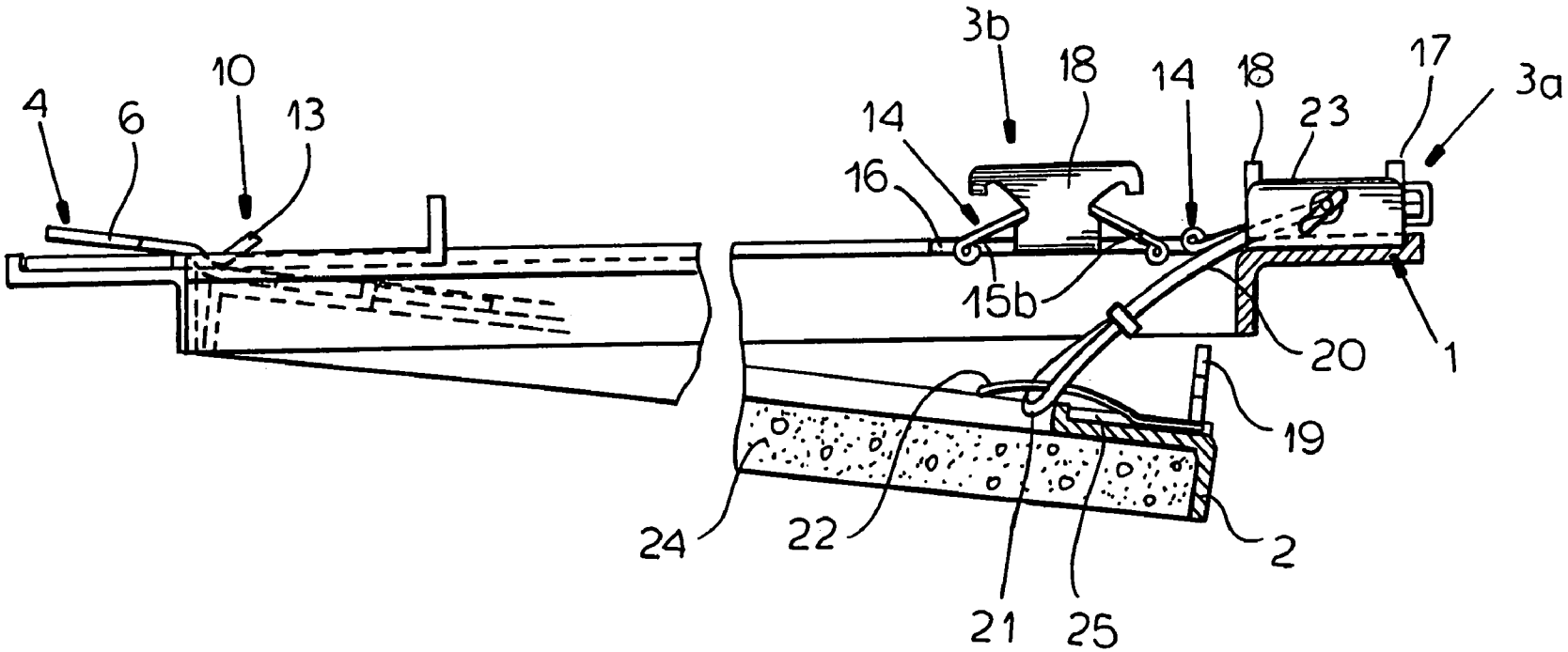
FIG. 2 is a horizontal section through the access door in partly open condition.
Figure 3:
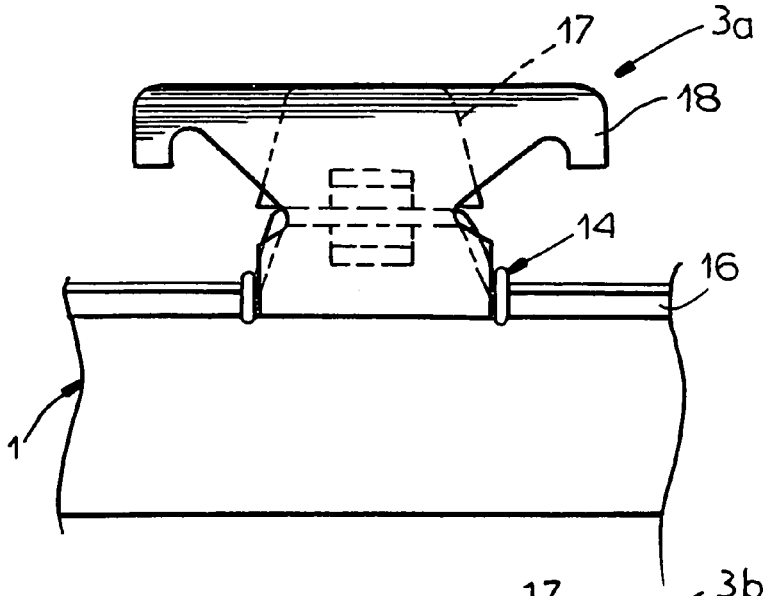
FIGS. 3 and 4 are views from inside showing the latches of the door.
Figure 4:
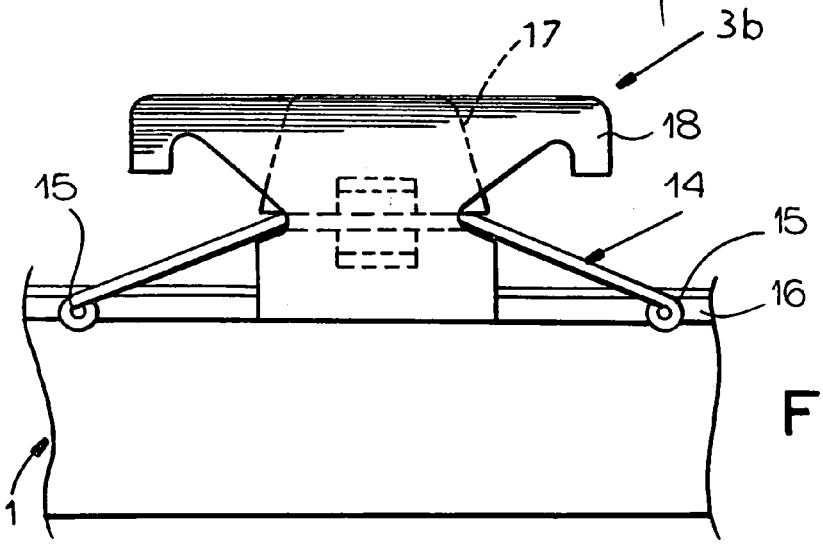
Figure 5:
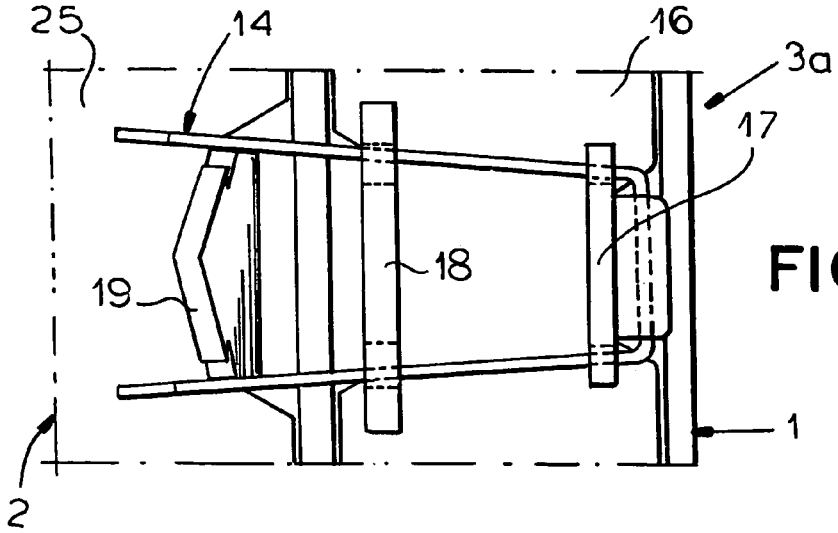
FIG. 5 is a back view of one of the latches during opening of the door.

Thus the latches 3a spring-bias the inner frame 2 transversely toward the left as seen in FIG. 2, thereby pressing the tabs 9 into the floors of the grooves 8, while the latches 3b similarly center the inner frame 2 longitudinally. The tongues 19 are also shaped to receive the arms 15 of the respective springs 14 such that when fitted together there is not only this transverse and longitudinal centering effect but there is also in/out positioning to ensure that the back flange of the frame 2 is coplanar with the back flange off the frame 1 and that the inner frame 2 is releasably retained in the FIG. 1 closed position.

Midway between the latches 3*a* there is a further latch comprised of a flexible strand or element 20 having its ends seated in symmetrically arranged brackets 23 fixed on the back flange of the outer frame 1 and forming a loop 21 engageable over a hook 22 provided on the back face of the back flange of the inner frame 2. The strand 20 is elastomeric so that, when engaged over the hook 22, it holds the inner frame 2 in the FIG. 1 closed position, but the inner frame 2 can be pivoted out as shown in FIG. 2 with elastic elongation of the strand 20 sufficiently that it can be unhooked and the frame 2 and panel 24 can be taken out of the outer frame 1. During such outward pivoting, the arms 15 are pulled off the keeper tongues 19.

The access door according to the invention is opened as described in above-cited German 37 36 060 by pushing in on one or both of the corners with the latches 3*a* and 3*b* so that the door assembly formed by the frame 2 and panel 24 pops out slightly, allowing it to be pulled open wide enough to unhook the strand 20 and pivot it all the way out.

I claim:

1. An access door comprising:

a rectangular outer frame adapted to be set in a wall and having two longitudinal sides and two transverse sides defining four corners;

a rectangular inner frame congruent to the outer frame, having longitudinal and transverse sides and four corners, and dimensioned to fit within the outer frame;

hinge means at two corners at ends of one of the longitudinal sides for holding the inner frame in the outer frame and for pivoting of the inner frame in the outer frame generally about the one longitudinal side; and two transversely effective spring latches at the other longitudinal side near ends thereof between the inner and outer frames; and two longitudinally effective spring latches at the transverse sides near the other longitudinal side between the inner and outer frames, each of the spring latches being provided with:

a keeper tongue on the inner frame, and a spring on the outer frame engageable over the respective tongue, the springs of the longitudinal latches having bent-out ends bearing inward on the inner frame.

2. The access door defined in claim 1 wherein each of the springs is generally U-shaped and has a bight secured to the outer frame and a pair of arms bearing on the keeper tongue of the inner frame.

3. The access door defined in claim 1 wherein each of the keeper tongues is a tab bent outward from and fixed to the inner frame.

4. The access door defined in claim 1 wherein the springs of the longitudinal latches bear longitudinally inward on the inner frame.

5. The access door defined in claim 1, further comprising centering formations on the frames at the one longitudinal side for transversely and longitudinally centering the inner frame in the outer frame at the one longitudinal side.

6. An access door comprising:

a rectangular outer frame adapted to be set in a wall and having two longitudinal sides and two transverse sides defining four corners;

a rectangular inner frame congruent to the outer frame, having longitudinal and transverse sides and four corners, and dimensioned to fit within the outer frame;

respective hinges at two corners at ends of one of the longitudinal sides each comprising an outer hinge leaf on the outer frame and an inner hinge left on the inner frame fitting loosely with the respective inner hinge leaf and permitting limited relative longitudinal and transverse movement of the inner and outer frames relative to each other, the inner frame being pivotal by the hinges in the outer frame generally about the one longitudinal side; and two transversely effective spring latches at the other longitudinal side near ends thereof between the inner and outer frames; and two longitudinally effective spring latches at the transverse sides near the other longitudinal side between the inner and outer frames, each of the spring latches being provided with:

a keeper tongue on the inner frame, and a spring on the outer frame engageable over the respective tongue the springs of the longitudinal latches having bent-out ends bearing inward on the inner frame.

7. The access door defined in claim 6 wherein each of the frames includes a back flange lying in a plane, with both back flanges being generally coplanar in a closed condition of the door and an edge flange projecting perpendicularly from the respective back flange, the tongues projecting generally parallel to the respective edge flanges from the respective back flanges.

8. The access door defined in claim 7 wherein both of the back flanges have inside faces and the tongues and springs are mounted on the inside faces.

* * * * *

UNITED STATES PATENT AND TRADEMARK OFFICE

CERTIFICATE OF CORRECTION

PATENT NO. : 7,243,462 B2
APPLICATION NO. : 10/944687
DATED : July 17, 2007
INVENTOR(S) : Günter Langenhorst It is certified that error appears in the above-identified patent and that said Letters Patent is hereby corrected as shown below:

Title Page, Item (73) Assignee: delete “Iphoven” and insert -- Iphofen --.

Signed and Sealed this

Twenty-seventh Day of November, 2007

JON W. DUDAS
*Director of the United States Patent and Trademark Office*